US006048385A

United States Patent [19]

Koide

[11] Patent Number: 6,048,385

[45] Date of Patent: Apr. 11, 2000

[54] ELECTRIC DISCHARGE WIRE-HOLDING STRUCTURE FOR WET-TYPE ELECTRIC DUST COLLECTOR

[75] Inventor: Tetsukazu Koide, Kobe, Japan

[73] Assignee: Shinko Pantec Co., Ltd., Hyogo, Japan

[21] Appl. No.: 09/046,301

[22] Filed: Mar. 23, 1998

[30] Foreign Application Priority Data

Jul. 15, 1997 [JP] Japan ..... 9-189418

[51] Int. Cl.[7] ..... B03C 3/41

[52] U.S. Cl. ..... 96/83; 96/92; 96/96; 313/271; 313/272

[58] Field of Search ..... 96/83, 96, 89–92; 313/271, 272, 278, 281

[56] References Cited

U.S. PATENT DOCUMENTS

| | | | |
|---|---|---|---|
| 3,425,190 | 2/1969 | Ragland | 96/91 |
| 3,495,379 | 2/1970 | Hall et al. | 96/96 X |
| 4,099,219 | 7/1978 | Laing | 96/89 X |
| 4,134,040 | 1/1979 | Klotzman | 96/89 X |
| 4,349,359 | 9/1982 | Fitch et al. | 96/96 X |

FOREIGN PATENT DOCUMENTS

| | | | |
|---|---|---|---|
| 510199 | 10/1930 | Germany | 96/92 |
| 1-164458 | 6/1989 | Japan . | |
| 6-91200 | 4/1994 | Japan | 96/96 |

*Primary Examiner*—Richard L. Chiesa
*Attorney, Agent, or Firm*—Marshall, O'Toole, Gerstein, Murray & Borun

[57] ABSTRACT

An electric discharge wire-holding structure for a wet-type electric dust collector is disclosed. The holding structure is capable of increasing the service life of electric discharge wires by preventing the presence of a minute clearance at the end of the electric discharge wire which is fastened on the electrode bar, thereby providing a continuous path for a flowing current and preventing electric wear due to a potential difference. The holding structure includes a hook provided at the fastened end of an electric discharge wire, and which is fastened on a planar set seat formed on an electrode bar by a set screw.

2 Claims, 3 Drawing Sheets

ELECTRIC DISCHARGE WIRE-HOLDING STRUCTURE FOR WET-TYPE ELECTRIC DUST COLLECTOR

FIELD OF THE INVENTION

The present invention relates to an electric discharge wire-holding structure for a wet-type electric dust collector. More particularly, the present invention relates to an electric discharge wire-holding structure for a wet-type electric dust collector wherein one end of the electric discharge wire of the wet-type electric dust collector is fastened on an electrode bar in a manner such that the wire can be freely attached and detached.

BACKGROUND OF THE INVENTION

Wet-type electric dust collectors have been in practical use as electric dust collectors. In a wet-type electric dust collector, a plurality of electric discharge wires are used as ionizing discharge electrodes. It has been proposed in such a configuration that, when installing these electric discharge wires on a support frame, one end (i.e., the upper end) of the electric discharge wire is elastically supported by means of a plurality of mounting members, for example, with interposing springs or other elastic members, and the other end (i.e., the lower end) is fastened on an electrode bar which extends horizontally from the support frame.

The electrode bar and the electric discharge wires are made of HASTELLOY when used in an environment of high temperature and a corrosive or oxidizing atmosphere.

HASTELLOY is an alloy containing Ni-Cr-Mo as main components, and HASTELLOY C-276, in particular, is employed in applications which require durability to high temperatures and corrosion or oxidation.

When ends of the electrical discharge wires are fastened on the electrode bar by welding, a difficulty arises because the electrical discharge wires cannot be changed. In practical use, this technique utilizes one end of an electric discharge wire inserted in a set hole made in the electrode bar, and the end of the electric discharge wire is bent. The bent portion of the wire is engaged in the set hole by housing it in a set seat formed by enlarging the bottom half of the set hole, thereby fastening the electric discharge wire. In this case, there is a minute clearance, or gap, between the electric discharge wire and the set hole of the electrode bar, or between the bent end portion of the electric discharge wire and the set seat in the electrode bar, and a minute clearance can arise in a portion of linear contact due to vibrations or the like, thereby causing a potential difference in the minute clearance when the electric discharge wire discharges. This results in electrical wear of the material.

Use of HASTELLOY as the material of construction for the electrode bar and the electric discharge wire also contributes to this problem because the high hardness of the HASTELLOY makes it difficult to bring the bent portions of the electric discharge wires and the set holes in close contact without a clearance.

SUMMARY OF THE INVENTION

One aspect of the present invention is to provide a configuration for securing the electric discharge wires in a wet-type electric dust collector which is capable of increasing the service life of the electric discharge wires and allows the electric discharge wires to be easily detached and attached. These features are accomplished by preventing the presence of a minute clearance, or gap, at the end of the electric discharge wire that is fastened on the electrode bar, thereby providing a continuous path for flowing current and preventing the occurrence of electrical wear due to a potential difference.

In order to achieve this aspect of the invention, the electric discharge wire is provided with a hook at the end of the electric discharge wire to be fastened, such that the hook is fastened on a planar set seat formed on the electrode bar by means of a screw from under the members which are in close contact with one another.

The hook of the electric discharge wire is formed by either bending the end of the electric discharge wire or attaching a crimp terminal to the end of the electric discharge wire. The shape of the hook is not limited to any particular shape. In addition, a hook having an open release portion can be a ring provided in a crimp terminal, with the hook being of a sufficient size to allow insertion of a set screw.

With this configuration, when the set screw is passed through the hook and screwed into a threaded hole made in the set seat of the electrode bar to fasten the hook securely, the electrode bar, the electric discharge wire, and the set screw come into contact with each other to form an integral path for flowing current. This intimate contact prevents electrical wear due to a potential difference caused by the occurrence of a minute clearance in the electric discharge wire fastening portion and increases the service life of the electric discharge wire.

Also, because the electric discharge wire can be attached and detached by means of the set screw, operation and maintenance of the device are made easier.

In addition, because the electrode bar typically is a round rod, the set seat to be processed on the electrode bar of the round rod shape preferably is made by cutting a recess on one side of the electrode bar and forming inclined faces on both front and rear ends of the set seat, when viewed in the longitudinal direction, to become continuous with the electrode bar surface.

In a configuration as described above, the end of the electric discharge wire fastened on the electrode bar by the set screw is embedded in the electrode bar, and there is no corner or protrusion extending beyond the outer profile of the electrode bar. The inclined surfaces formed at the front and rear ends of the set seat increases the distance from the head of the set seat and makes it difficult for dust to build up, which prevents an erroneous electric discharge from occurring, thereby improving electrical stability and making the invention more effective in practice.

DESCRIPTION OF THE PREFERRED EMBODIMENT

One embodiment of the present invention is described below with reference to the accompanying drawings.

Figure 1:
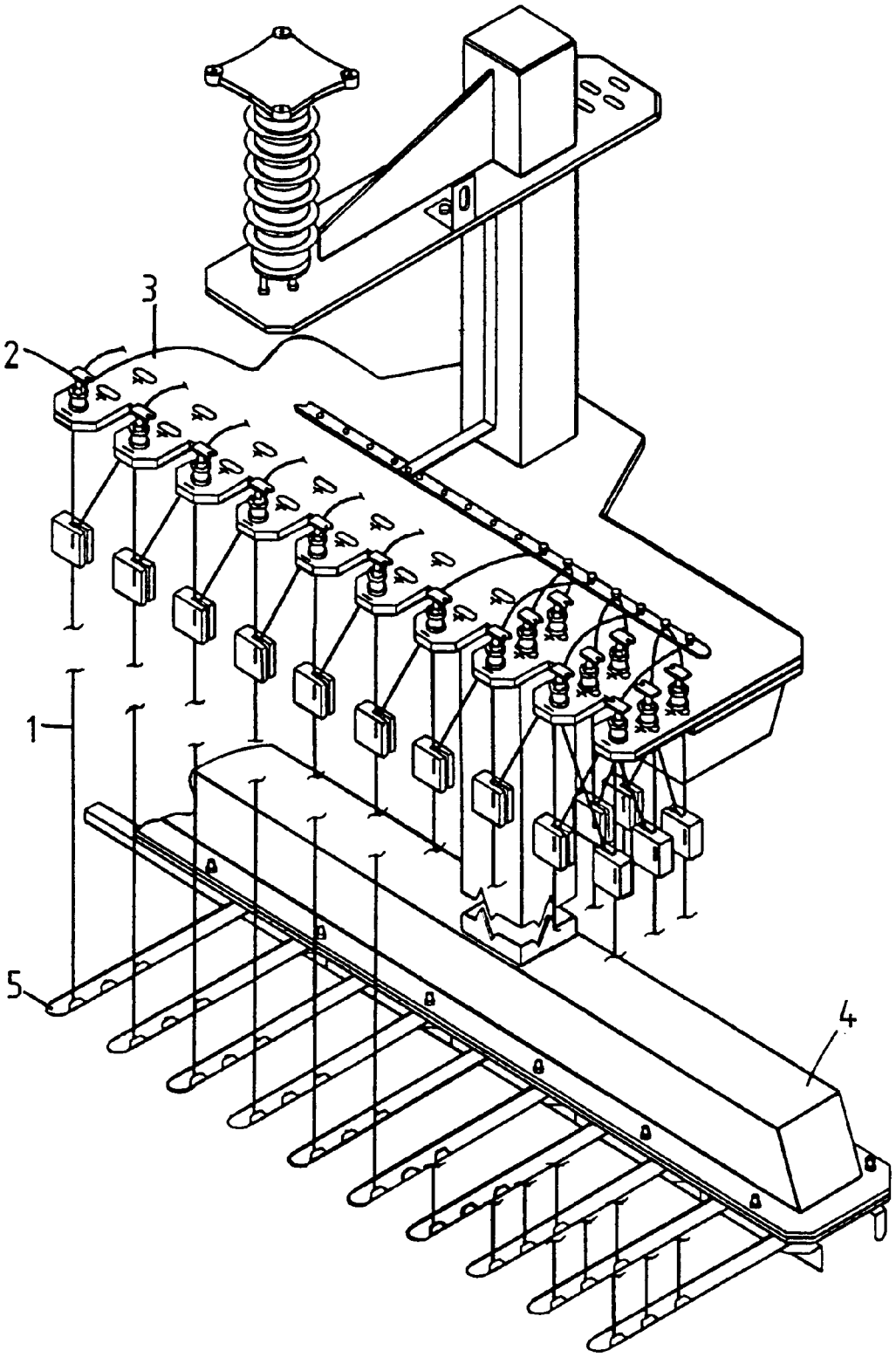
FIG. 1 is a perspective view illustrating a key portion of a wet-type electric dust collector of the present invention.

FIG. 1 is a perspective view illustrating a key portion of a wet-type electric dust collector of the present invention.

Figure 2:
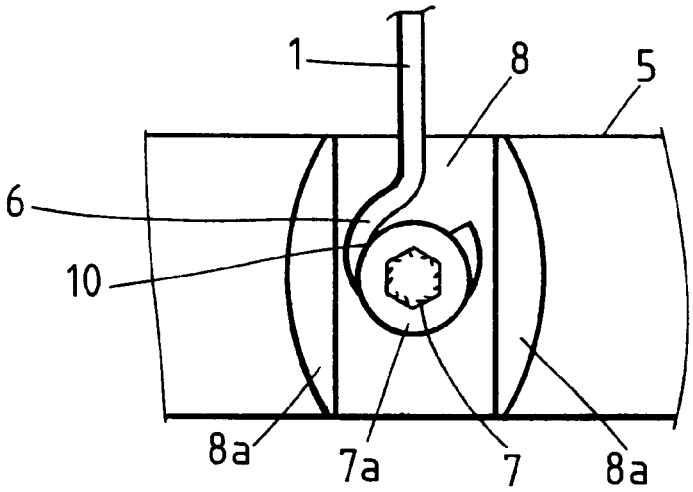
FIG. 2 is a front view illustrating an electric discharge wire fastened on an electrode bar.
Figure 3:
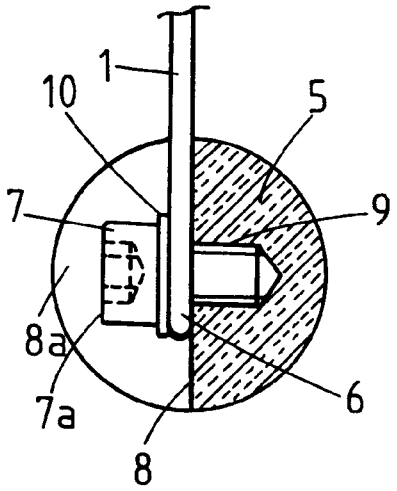
FIG. 3 is a cross sectional view illustrating an electric discharge wire fastened on an electrode bar.
Figure 4A:
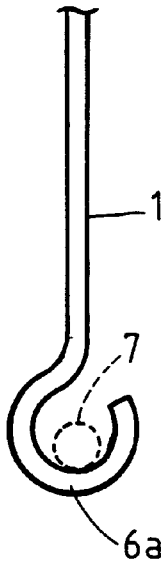
FIGS. 4(*a*) and (*b*) are front views illustrating one embodiment of a hook of an electric discharge wire.
Figure 4B:
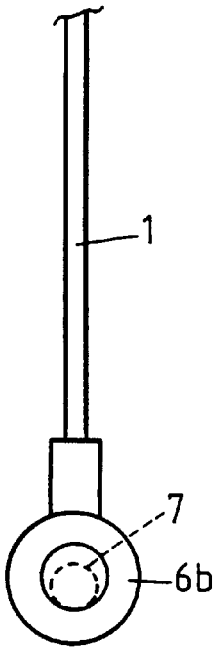

FIG. 2 is a front view illustrating an electric discharge wire fastened on an electrode bar. FIG. 3 is a cross sectional view illustrating an electric discharge wire fastened on an electrode bar. FIGS. 4(*a*) and (*b*) are front views illustrating one embodiment of a hook of an electric discharge wire.

In the drawings, numeral 1 denotes an electric discharge wire made of HASTELLOY C-276, and is used as an electric discharge electrode in a wet-type electric dust collector. The upper end of electric discharge wire 1 is fastened on an upper support frame 3 by means of an upper holding member 2, and the lower end of discharge wire 1 is fastened on an electrode bar 5 made of HASTELLOY C-276 and protruding from a lower support frame 4.

The upper holding member 2 comprises a plurality of components, including a spring or the like, not shown, which applies a proper tension to the electric discharge wire.

In order to fasten the lower end of electric discharge wire 1 on electrode bar 5, the present invention employs a configuration described below.

A hook 6 is provided at the fastening end of electric discharge wire 1. Hook 6 is formed by either bending an end of electric discharge wire 1 in the form of a hook 6*a* shown in FIG. 4(*a*), or attaching a crimp terminal 6*b* as shown in FIG. 4(*b*), thereby allowing a set screw 7, which is also made of HASTELLOY C-276, to be inserted therethrough.

On the other hand, as set forth in FIGS. 2 and 3, a planar set seat 8 is formed at a portion of electrode bar 5 where the electric discharge wire is fastened, and a threaded hole 9 is made in set seat 8.

To fasten the end of electric discharge wire 1 on electrode bar 5, set screw 7 is inserted through hook 6 and is screwed into threaded hole 9.

When hook 6 of electric discharge wire 1 is fastened on set seat 8 of electrode bar 5 using set screw 7, the electrode bar 5, hook 6 of the electric discharge wire 1, and set screw 7 come into contact with each other to form an integral path for flowing current, thereby preventing electrical wear due to a potential difference caused by the occurrence of minute clearance, or gap, in the fastening portion of electric discharge wire 1 and increasing the service life of electric discharge wire 1.

Set seat 8 is provided on an electrode bar 5 having round rod shape by cutting a recess on one side of electrode bar 5 and forming inclined faces 8*a* on both the front and rear ends of the set seat, viewed in the longitudinal direction. The depth of set seat 8 is determined such that, when hook 6 of electric discharge wire 1 is fastened on set seat 8 by means of set screw 7, head 7*a* of the set screw does not protrude beyond the outer profile of electrode bar 5. Inclined surface 8*a* formed on the front and rear ends of set screw 8 enlarges the distance from head 7*a* of the set screw, thereby making it difficult for dust to build up, and the angle of inclination of inclined surface 8*a* with respect to set seat 8 is properly set. The configuration of set seat 8 comprising the planar processed portion and the inclined surface is predetermined after considering the need to reduce processing costs and to achieve the maximum effect with the minimum man hours of processing because HASTELLOY C-276 is difficult to process and several hundred electric discharge wires 1 are necessary, depending on the scale of the apparatus, and the same number of set seats 8 as the number of electric discharge wires 1 must be processed.

Numeral 10 in FIGS. 2 and 3 denotes a washer interposed between hook 6 and set screw 7. Washer 10 preferably is constructed of the same material as that of electric discharge wire 1, electrode bar 5, and set screw 7, and is set to the same electrical potential.

The present invention typically is practiced in the configuration described above. According to the present invention, because the end of the electric discharge wire is fastened on the electrode bar by means of the set screw, the electrode bar, and the fastened end of the electric discharge wire, the elements are in intimate electrical contact via the set screw to form a continuous electric path. This arrangement prevents electrical wear caused by an electrical potential attributed to a minute clearance at the fastening end of the electric discharge wire, thus increasing the service life of the electric discharge wire.

In addition, because the electric discharge wire can be easily attached and detached with respect to the electrode bar, maintenance of the apparatus is facilitated. Moreover, because there are no protrusions extending beyond the outer profile of the electrode bar, dust and the like does not build up in the clearance that exists between the head of the set screw and the set seat, and electrical stability is improved without an erroneous discharge. Finally, a lower processing cost makes it easier to employ a desirable material, such as HASTELLOY, which is difficult to process.

What is claimed is:

1. In an electric discharge wire-holding structure for a wet electric dust collector comprising an electric discharge wire having a hook at one end of the discharge wire, wherein said hook is fastened to a planar set seat formed on an electrode bar by a set screw, the improvement wherein said set seat is a recess on the electrode bar, thereby forming inclined surfaces on both front and rear ends of said set seat to become continuous with the electrode bar surface.

2. The electric discharge wire-holding structure for a wet electric dust collector according to claim 1, wherein at least one of the electrode bar and the electric discharge wire comprises an alloy containing Ni-Cr-Mo as main components.

* * * * *